United States Patent [19]

Kosmatka

[11] Patent Number: 4,570,210

[45] Date of Patent: Feb. 11, 1986

[54] VEHICLE LAMP UNIT AND METHOD FOR AN IMPROVED SUPPORTING ARRANGEMENT OF ITS LIGHT SOURCE

[75] Inventor: Walter J. Kosmatka, South Euclid, Ohio

[73] Assignee: General Electric Company, Schenectady, N.Y.

[21] Appl. No.: 562,917

[22] Filed: Dec. 19, 1983

[51] Int. Cl.[4] ..... F21M 3/30

[52] U.S. Cl. ..... 362/396; 362/390; 362/382

[58] Field of Search ..... 362/382, 390, 391, 396, 362/306; 313/113

[56] References Cited

U.S. PATENT DOCUMENTS

| | | | |
|---|---|---|---|
| 872,200 | 11/1907 | Rowe | 362/396 |
| 1,044,772 | 11/1912 | Gilbough | 362/396 |
| 2,527,442 | 10/1950 | Odegaard | 362/396 |
| 4,210,841 | 7/1980 | Vodicka | 313/221 |
| 4,282,566 | 8/1981 | Newman | 362/390 |
| 4,387,417 | 6/1983 | Plemmons | 362/390 |
| 4,414,613 | 11/1983 | Mayer | 362/396 |
| 4,470,104 | 9/1984 | Cox | 362/396 |

*Primary Examiner*—Ronald B. Cox

*Attorney, Agent, or Firm*—John P. McMahon; Philip L. Schlamp; Fred Jacob

[57] ABSTRACT

A vehicle lamp unit having an improved supporting arrangement for the light source of the unit is disclosed. Also disclosed is an improved supporting arrangement for a light source having platform members that allow the light source to be attached to a base which is then inserted into complementary locating openings of a lamp unit in a vehicle. Further disclosed is a method of connecting the light source to the improved mounting arrangement.

14 Claims, 8 Drawing Figures

Fig. 3a
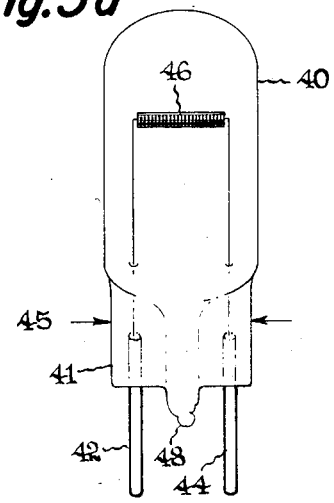
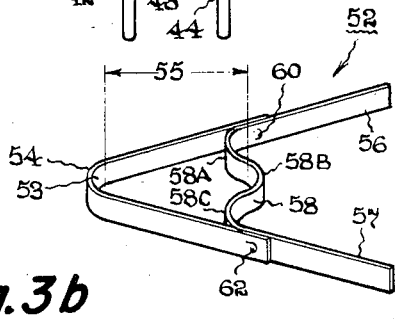
Fig. 3b
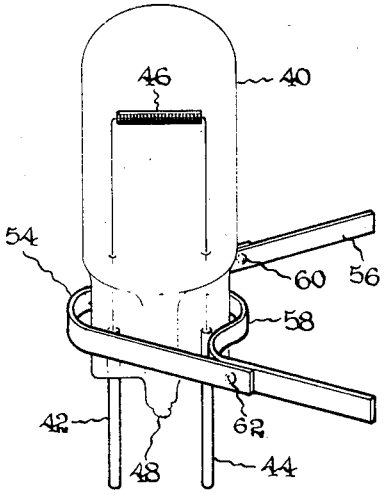
Fig. 3c
Fig. 3d
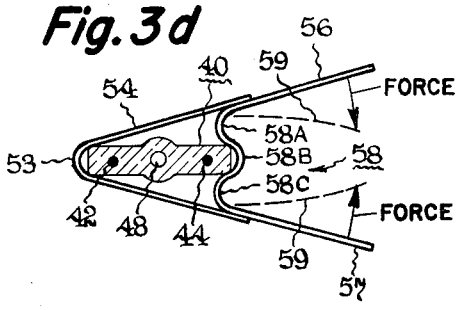
Fig. 3e
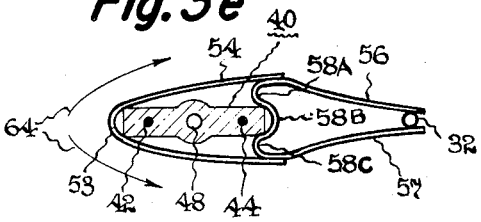
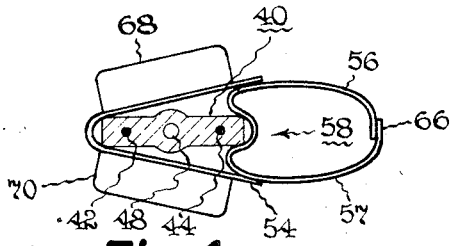
Fig. 4

VEHICLE LAMP UNIT AND METHOD FOR AN IMPROVED SUPPORTING ARRANGEMENT OF ITS LIGHT SOURCE

BACKGROUND OF THE INVENTION

The present invention relates to a lamp unit which has particular utility for vehicle lamps. More particularly, the present invention relates to vehicle lamp units having an improved strap assembly for holding and supporting a light source within the vehicle lamp unit and also a method of clamping the light source to the improved strap assembly within a vehicle lamp.

Vehicle lamps such as sealed beam headlamp units are well-known and are disclosed in U.S. patent application Ser. No. 504,202 of B. E. Shanks, filed June 14, 1983 now abandoned and U.S. patent application Ser. No. 546,011 of R. F. Malinowski filed Oct. 27, 1983, now U.S. Pat No. 4,509,107 both of which are assigned to the same assignee as the present invention. The sealed beam headlamp of Shanks has a filament assembly which serves as a light source. The light source is internally arranged and predeterminedly located at a desired optical position within the unit. The filament is connected across ferrules, which, in turn, are connected to mating contact plugs or electrical terminals. The electrical terminals are connected to suitable electrical connectors, within the automobile, through which the filament is selectively energized in accordance with the switching devices within the automobile.

Vehicle lamps when placed within their intended environment encounter actual on-the-road use which subject the vehicle lamp to the vibrations of the engine of the vehicle and also to vibrations due to the tire interaction with the road surface being transmitted through the suspension system of the vehicle to the lamp unit. Further, vehicle lamps in their intended environment may also be subjected to substantial shock effects. The operating environment of the vehicle lamp may typically be manifested in forces which stress the metal parts of the vehicle lamp, more particularly, force which stress the metal parts of the support members supporting the light source of the lamp unit. The metal support members holding the light source within the lamp unit typically experience metal fatigue, which, in turn, ultimately results in a failure of the light source. The light source failure may be manifested in an open condition of the filament serving as the light source, or in movement of the light source with the lamp unit which in either case renders the vehicle lamp unfit for its intended use.

The failure of the light source due to the operating vibrations of the vehicle may be substantially reduced by strengthening the mounting arrangement of the light source within the lamp unit. The mounting arrangement may be stiffened so as to reduce the flexure induced by specific vibration frequencies of the vehicle typically in a range of about 50 Hz to about 500 Hz and by specific shock effects in the range of about 10 g's to about 20 g's. The mounting arrangement of the light source within the unit may be stiffened such that the frequency at which the mounting arrangement resonates may be raised above that previously discussed typical operating range experienced by the motor vehicle.

The stiffening of the light source mounting arrangement may be accomplished by increasing the dimensions of the support elements thereof. One manner to accomplish such an increase is to increase the dimensions of the external leads of the light source that interconnect the filament to external devices. If the light source is of a halogen type, the external leads are commonly embedded, sealed and brought out through the base of the halogen lamp having a sealed exhaust tip. The extent of the increased dimensions of the external leads should take into account the strength of the supporting glass in which the external lead wires are embedded. Increasing the external lead wire diameter commonly decreases the amount of supporting glass of the lamp and ultimately the thinner glass becomes the failure of fracture point of the halogen lamp when subjected to the vehicle vibrations. Further, reliance on external leads to provide for increased stiffening of light source mounting has a further disadvantage in that external lead wires may be somewhat embrittled by assembly or sealing operations related to the glass halogen type lamp. It is desired that the strengthening of the light source mounting be accomplished without relying upon an increase in the external lead wire diameter.

The increased support may also be accomplished by a strap assembly connected to a support member and placed around the halogen light source. The strap assembly should take into account the glass geometry in which it is mated and frictionally engages the glass envelope of the halogen light source. Frictional engagement should not overstress the glass so as to result in a fracture when the engagement is too tight or causes the glass to be placed in a tension condition ultimately resulting in glass fracture. Overstress of the glass is particularly noted if tensile type stresses result from the frictional engagement of the strap assembly to the glass envelope. It is desired that the frictional engagement only exert compressive forces onto the glass envelope which forces are less prone to cause glass fracture. Such a strap arrangement conforming to the glass geometry of the halogen light source may require by its very nature careful hand fitting and welding operations particularly if the strap assembly is mated to the base of the halogen light source having an irregular shape caused by the sealing and venting operation at the exhaust tip of the base. These careful operations typically result in an increase to the final cost of the vehicle lamp unit. It is desired that a strap assembly be mated to the glass geometry without encountering the previously discussed disadvantages.

The mounting arrangement may also be strengthened by potting methods that apply silicone adhesives or ceramic compositions to the light source mounting arrangement. These methods while increasing the support of the light source are relatively expensive and typically require a relatively long time for the silicone adhesive or ceramic compositions to cure and adhere to the light source. In the case of the ceramics a further disadvantage is encountered in that the ceramics may damage the glass surface to which they adhere. In the case of silicone adhesives, a further disadvantage is encountered in that the adhesion of these compositions is not generally capable of withstanding bulb temperature. Further, a disadvantage related to both the silicone and ceramic compositions is that the additional mass added by these compositions may adversely affect the vibration strength of the support member.

Accordingly, it is an object of the present invention to provide an improved support arrangement of a light source within a vehicle lamp that is not limited to the disadvantages of the prior known methods and allows the support arrangement to be easily connected to a halogen light source having an irregular shape particularly noted at its base.

It is a further object of the present invention to provide an improved supporting arrangement of a light source that only exerts compressive forces onto the halogen light source which are less prone to cause glass fracture when compared to tensile type stresses onto the halogen light source.

Still further, it is an object of the present invention to provide an improved light source support arrangement that does not require or even depend on the support of the external leads of the lamp unit.

Further still, it is an object of the present invention to provide a vehicle lamp unit that withstands the vibration and shock conditions encountered in a vehicle environment without experiencing a light source failure.

SUMMARY OF THE INVENTION

The present invention is directed to an improved strap assembly for rigidly holding a light source particularly suited for use in a vehicle lamp. The strap assembly comprises a first and a second member both of a flexible metal material. The first strap member has a V-like shape with its joined sections curved to contact one of the outer edge portions of the light source when mated with the light source. The second strap is joined to the first strap member and has a W-like shape with one of its joined sections curved to contact the other outer edge portion of the light source when mated with the light source. The second strap member has contractable legs. The first and second members are separated from each other by a predetermined parameter having dimensions sufficient to receive the light source. The first and second strap members are capable of being contracted together to form a predetermined shape and effective to cause the strap assembly to frictionally engage the light source. The strap assembly is used in combination with a light source enclosed within a light-transmissive envelope having a base and inleads and is particularly suited for the vehicle lamp. In one embodiment the vehicle lamp has a reflector. The light source is predeterminedly located relative to the focal point of the unit and connected across a pair of metal ferrules which are respectively connected to a pair of electrical terminals. The lamp unit further comprises the strap assembly for rigidly holding and supporting the light source. The first and the second strap members are separated from each other by a predetermined parameter having dimensions sufficient to receive the base of the envelope. The first and second strap members are contracted together to form a predetermined shape and effective to cause the strap assembly to tightly engage around the base of the lamp without any electrical contact between the strap assembly and the inlead of the light source. The contracted assembly is connected to a support member to one of the ferrules. The engagement is effective to withstand vibration and shock effects typically experienced by the vehicle lamp unit. In another embodiment, the strap assembly has platform members which allow the light source having the rigidly affixed strap assembly to be inserted into and retained by locating openings in a lamp unit mounted in a vehicle.

The present invention is also directed to a method of connecting the light source enclosed within the light-transmissive envelope to a metal support strap member both being of a lamp unit. In one embodiment, the method comprises the steps of, (a) providing a light source enclosed in a light-transmissive envelope having a base with predetermined dimensions; (b) providing a metal support strap member having extending legs and having an open and a closed shape with the open shape having a passageway with predetermined dimensions sufficient to accept insertion of the base of the envelope and the close shape being formed by contracting the legs of the metal support strap member effective to reduce the dimensions of the passageway; (c) inserting the base of the envelope into the open shape of the metal support strap member; (d) contracting the legs of the metal support member so that the passageway frictionally engages the base of the innner envelope; and (e) joining together the contracted legs of the metal support strap member. In a further embodiment the method comprises an additional step in which the contracted legs of step (e) are further joined to a support member of the lamp unit.

The features of the invention believed to be novel are set forth with particularity in the appended claims. The invention, itself, however, as regards to its structure, method and advantages thereof may best be understood with reference to the following description taken in conjunction with the accompanying drawing.

BRIEF DESCRIPTION OF THE DRAWING

FIGS. 3(*a*) through 3(*e*) illustrate one method of connecting the light source to the improved strap assembly of the present invention.

FIG. 4 illustrates an alternate improved strap assembly of the present invention.

DETAILED DESCRIPTION OF THE PREFERRED EMBODIMENTS

Figure 1:
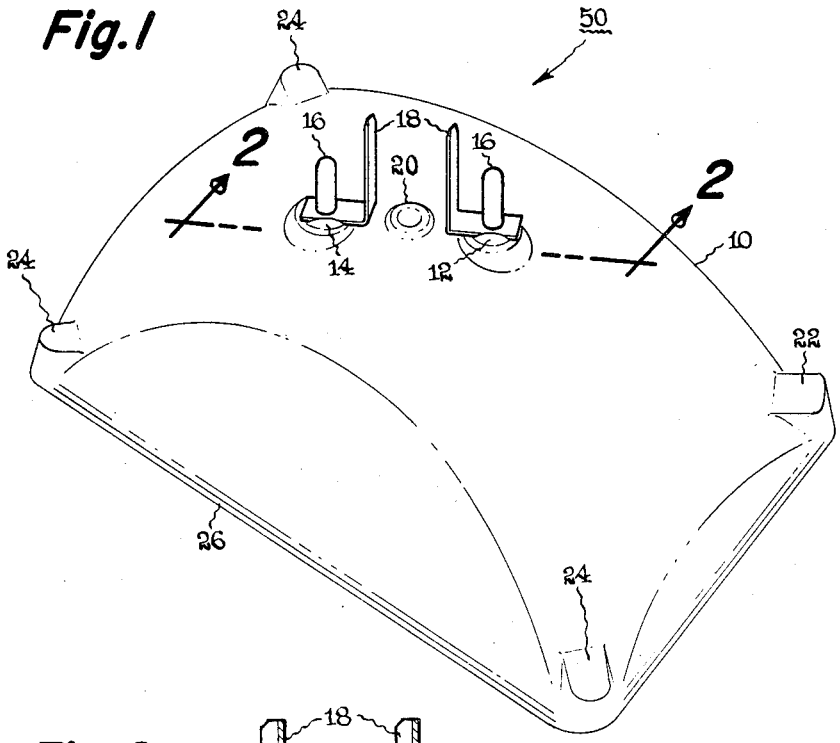
FIG. 1 is a perspective view illustrating one embodiment of the present invention showing a rectangular sealed beam headlamp unit.

The unit illustrated in FIG. 1 comprises a rectangular glass seal beam headlamp unit 50 constructed in accordance with one embodiment of the present invention and having particular utility for vehicle lamps. The unit 50 comprises, in part, a dome-shaped reflector 10 and a slightly flared rectangular peripheral rim 26. Although the unit 50 of FIG. 1 is illustrated without a lens applied, it should be recognized that the practice of this invention contemplates a combined glass reflector and lens construction or, alternatively, a unitary sealed headlamp as disclosed in U.S. Pat. No. 4,210,841, entitled "All Plastic Headlamps" which is assigned to the same assignee as the present invention.

The reflector 10 of FIG. 1 has four sealing pads, one of which is a key pad 22 and the remaining three of which are similar but non-keyed and are indicated by reference number 24. The four sealing pads when positioned into a complementary sealing surfaces on a vehicle, such as an automobile or an off-highway earth moving vehicle, and suitably affixed thereto, allow the illumination created by the vehicle lamp to be focused in a direction determined by the orientation of the vehicle.

The sealed beam headlamp unit 50 has an exhaust hole 20 which serves as a means to ventilate the interior of the sealed lamp during the manufacturing process of the lamp. The exhaust hole 20 may be sealed in a manner as disclosed in the previously mentioned U.S. patent application Ser. No. 546,011.

The unit 50 of FIG. 1 further includes electrical terminal locating means 12 and 14 positioned equally spaced on opposite sides of the exhaust hole 20. The locating means 12 and 14 are provided in bosses formed on the outer walls of the reflector 10 and which extend through the bosses and the reflector through which metal ferrules 16 extend. The metal ferrules 16 are electrically connected to terminals 18 by an appropriate pressing action. The electrical terminals 18 provide for a reliable interconnection with electrical circuits of the vehicle in which the lamp unit 50 is utilized. The locating means 12 and 14 of lamp 50 may be of the type described in the previously mentioned U.S. patent application Ser. No. 504,202. The location of the terminals 18 and of ferrules 16 with respect to the reflector may be described with reference to FIG. 2.

Figure 2:
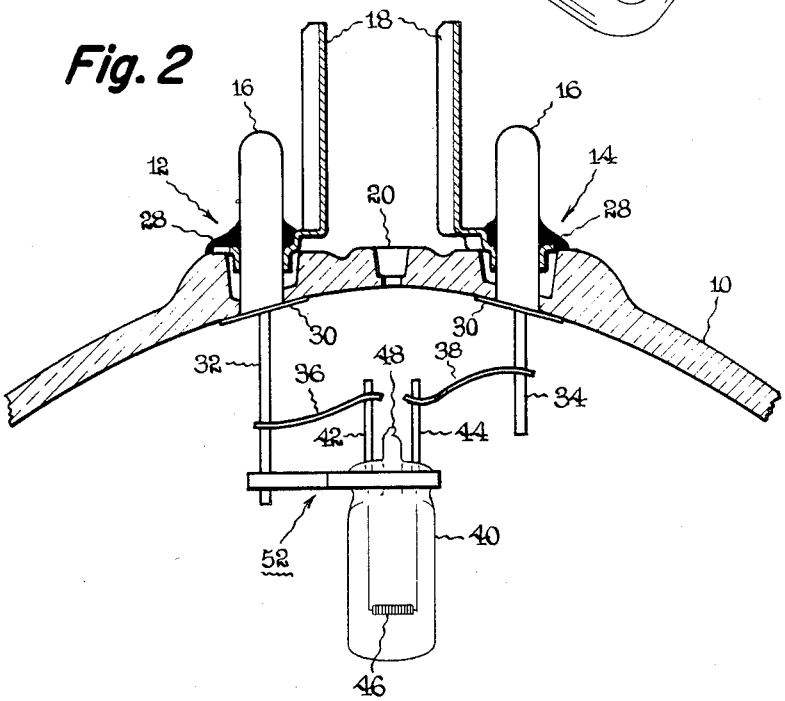
FIG. 2 is a sectional view taken along lines 2, 2 of FIG. 1 showing the internal and external connections and relationship thereof of the light source of the lamp of FIG. 1.

FIG. 2 is a sectional view of the lamp 50 taken along lines 2—2 of FIG. 1 showing a filament assembly 40 arranged across the locating means 12 and 14. The filament assembly 40 has a filament 46 having one end connected to a terminal 18 via external lead 42 of the filament assembly 40, electrical wire 36, member 32, and ferrule 16. Similarly the other end of the filament 46 is connected to terminal 18 via external lead 44 of the filament assembly 40, electrical wire 38, member 34 and ferrule 16. The members 32 and 34 are inserted and electrically connected by appropriate means such as soldering to their respective metal ferrule 16.

The vehicle lamp unit shown in FIG. 2 and also FIG. 1 as comprised, in part, of a reflector 10, and a light source shown as a filament assembly 40 having a light-transmissive envelope with an exhaust tip 48 at its base. The light source 40 is predeterminedly located relative to the focal point of the lamp unit 50 and shown in FIG. 3(*a*).

As discussed in the "Background" section, the connection of the light source 40 may be strengthened by various materials such as the use of larger diameter size wires for external leads 42 and 42, or by potting these wires 42 and 44 with silicon adhesives or ceramic compositions. Each of these methods have various disadvantages as discussed in the "Background" section. Further, as previously mentioned, the external lead wire 42 and 44 having a typical wire dimension of 1.0 mm protrude out of an irregular shaped base having an exhaust tip of the light source such as the filament assembly 40 shown in FIG. 3*a*.

The filament assembly 40 may be of the type GH8 or GH15 commercially available from the General Electric Company of the Lighting Business Group of Cleveland, Ohio. The filament assembly has a base 41 shown as having a dimension 45 meant to represent a width of 10 mm, a depth of 10 mm and a thickness of 2 mm. The irregular shaped base 41 does not lend itself to clamping by a strap assembly but such a limitation is overcome by the present invention. The dimension 45 of base 41 determines the dimension 55 of the strap assembly 52 of FIG. 3(*b*).

The strap assembly comprises a first support member 54 and a second support member comprised of legs 56 and 57 which are brought together by a portion 58 having curved sections 58A, 58B, and 58C. The first and second members are joined to each other by appropriate welds 60 and 62. The first and second strap members are separated from each other as shown in FIG. 3(*b*) by the previously mentioned predetermined parameter 55 having a length of 10.3 mm and an end radius of 1.5 mm dimension sufficient to receive the base of the light source 40. The strap assembly 52 may be comprised of a metal selected from the group consisting of steel, stainless steel, and spring steel. The strap assembly 52 has a thickness of about 0.3 mm and a width of about 4.0 mm.

The first and second strap members are contracted together to form a predetermined shape effective to cause the strap assembly 52 to tightly and frictionally engage about the base of the light source 40. The frictional engagement is accomplished without any contact, more particularly, without any electrical contact between the strap assembly 52 and the external leads 42 and 44 of the light source 40. The frictional engagement is effective to withstand vibrations or shock effects typically experienced by the vehicle lamp unit 50. The vibration effects may be in the range of about 50 Hz to about 500 Hz, whereas, the shock effects may be in the range of about 10 g's to about 20 g's.

The first strap member 54 of the strap assembly 52 has a V-like shape with its joined sections curved to conform to and contact one of the outer edge portions of the base of the lamp 40. The second strap member comprised of portions 56, 57 and 58 having curved sections 58A, 58B and 58C with section 58B curved to conform to and contact the other outer edge portion of the base of the envelope 40.

The strap assembly 52 when placed in its contracted predetermined shape engagement comprises the curved portion 53 engaging one side of the outer edge of the base of the envelope 40 and the curved section 58C of the second strap member engages the other of the outer edge portion of the base of the envelope 40.

The manner or method in which the strap assembly is mated to the filament assembly 40 may be described with reference to FIGS. 3(*a*) through FIG. 3(*e*).

FIGS. 3(*a*), 3(*b*), 3(*c*), 3(*d*) and 3(*e*) are meant to respectively illustrate five steps (a), (b), (c), (d) and (e) of one embodiment of the present invention for mating the strap assembly 52 to the filament assembly.

FIGS. 3(*a*) and 3(*b*), respectively, show the step (a) in which the light source 40 has the dimension 45 which determines the dimension 55 of the strap assembly 52 selected as step (b).

The open condition of the strap assembly 52 of FIG. 3(*b*) having dimension 55 serves as passageway sufficient to accept the insertion of the base 41 of the envelope 40. FIG. 3(*c*) shows step (c) in which the filament assembly is inserted by a forcing action into the open position of the strap assembly 52.

FIG. 3(*d*) is a bottom view showing the inserted filament assembly 40 within the opened position of the strap assembly 52 primarily formed between sections 53 and 58B of the strap assembly 52. FIG. 3(*d*) shows a force being applied to each of the legs 56 and 57 which contracts the strap assembly 52 shown in phantom so as to reduce the passageway into a smaller size by a forcing or squeezing action. The contraction of the legs 56 and 57 of a support assembly 52 is effective so that the passageway provided between portions 53 and 58B frictionally engage the base of the light source 40 as shown in FIG. 3(*e*).

FIG. 3(*e*) shows that the contracted legs 56 and 57 are held together and joined to the support member 32 of FIG. 2.

The strap assembly 52 is placed into its contracted predetermined engagement of the base of the envelope 40 in such a manner in that the stresses 64, shown in FIG. 3(*e*), involved are primarily compressive type stresses on the base 41 of the light source 40 rather than tensile type which are prone to cause fracture of the base 41. Further the tension of the light source 40 is maintained by the tortional forces caused by the elastic deformation of the strap legs 56 and 57 as the formed radii 58A and 58C deform and cause flattening of the radius 58B. Deformation of radii 58A and 58B additionally draws V-part 54 inward toward radius 58B thus shortening dimension 55 between radii 53 and 58B.

Although it is preferred that the contracted legs 56 and 57 be joined to support member 32 as shown in FIG. 3(*e*) in other embodiments it is desired that the contracted legs be joined to each other as shown in FIG. 4.

FIG. 4 shows the contracted legs 56 and 57 welded at a location 66 and not connected to support member 32. Affixed to strap member 52, by suitable means such as welding, brazing or soldering are platform members 68 and 70. This arrangement of FIG. 4 may be advantageously implemented as a replaceable inner bulb for a headlamp unit mountable on a vehicle. For such an implementation, the strap assembly 52 frictionally engaging the source 40 and having platform members 68 and 70 are used in cooperation with a cylindrical base cavity attachable to and mounted on a vehicle. The cylindrical base cavity has (1) locating openings for complementary acceptance of the platform members 68 and 70, (2) mating electrical connectors for complementary acceptance and electrical connections to the insertion of the inleads 42 and 44 of the light source 40, and (3) metallic platform having complementary dimensions which allow the platform members 68 and 70 to abut up against, and be affixed thereto by appropriate means such as welding or soldering. The platforms 68 and 70 when placed into their appropriate location with respect to the cylindrical base platform, being affixed to the cylindrical base platform are effective so that the light source 40 is internally arranged and predeterminedly located at the desired optical position within the headlamp unit mounted in the vehicle.

It should now be appreciated that the practice of the present invention provides for an improved strap assembly for holding and supporting the filament light source 40 within the light unit 50. Further, it should be appreciated that in accordance with the present invention that such a support is accomplished without any reliance on external bulb lead wires such as 42 and 48 of the filament assembly 40. Further, the practice of the present invention provides for such a rigid support for a light source 40 having an irregular shape base 41 with its exhaust tip 48.

In accordance with the practice of the present invention, the light source 40 was rigidly held and supported by the strap assembly 52 within a vehicle lamp such as unit 50 and subjected to a testing having vibrations in the range of about 50 Hz to about 500 Hz. The testing was conducted for a period of about 11 hours without experiencing a failure.

What I claim as new and desire to secure by Letters Patent of the United States is:

1. A strap assembly for rigidly supporting a light source within a lamp unit, said strap assembly comprising a first and a second strap member both of a flexible metal material:

said first strap member having a V-like shape with its joined sections curved to contact one of the outer edge portions of the light source when mated with said light source;

said second strap member being joined to said first strap member and having a W-like shape with one of its joined sections curved to contact the other outer edge portion of the light source when mated with said light source, said second strap member having contractable legs;

said first and second members separated from each other by a predetermined parameter having dimensions sufficient to receive said light source;

said first and second strap members capable of being contracted together to form a predetermined shape and effective to cause the strap assembly to frictionally engage said light source.

2. A strap assembly according to claim 1 wherein said strap assembly is comprised of a metal selected from steel, stainless steel, and spring steel and said strap assembly has a width of about 4 millimeters.

3. A rigidly supported light source for use in a lamp unit comprising:

a light source enclosed within a light-transmissive envelope having a base and inleads;

a strap assembly comprising a first and a second strap member both of a flexible metal material;

said first strap member having a V-like shape with its joined sections curved to contact one of the outer edge portions of said base of said envelope;

said second strap member joined to said first strap member and having a W-like shape with one of its joined sections curved to contact the other edge portion of said base of said envelope, said second strap member having contractable legs;

said first and second members contracted together to form a predetermined shape and effective to cause the strap assembly to frictionally engage the base of said light source without contacting said inleads.

4. A strap assembly according to claim 3 wherein said contracted predetermined shape engagement of said base of said envelope to said strap assembly is substantially limited to produce only compressive stresses on said base of said envelope.

5. A lamp unit particularly suited for a vehicle comprising a reflector, a light source enclosed within a light-transmissive envelope having a base, said light source being predeterminedly located relative to the focal point of the unit and connected across a pair of metal ferrules which are respectively connected to a pair of electrical terminals, said lamp unit further comprising:

a strap assembly for rigidly holding and supporting said light source, said strap assembly comprising a first and a second member, said second member having contractable legs, said first and second members along with said contractable legs all comprised of a flexible metal material, said first and second strap members being joined to each other, said first and second strap members separated from each other by a predetermined parameter having dimensions sufficient to receive said base of said envelope:

said first and second strap members being contracted together to form a predetermined shape and effective to cause the strap assembly to tightly engage around the base of said envelope without any electrical contact between the strap assembly and the inleads of the light source, said contracted assembly being connected by a support member to one of said ferrules, said engagement being effective to withstand vibration and shock effects typically experienced by said vehicle lamp unit.

6. A lamp unit particularly suited for a vehicle according to claim 5 wherein said predetermined location of said light source is maintained by said strap assembly without reliance on said light source connections to said metal ferrules.

7. A vehicle lamp according to claim 5 wherein said vibration effects are in a range of about 50 Hz to about 500 Hz and said shock effects in the range of about 10 g's to about 20 g's.

8. A method of connecting a light source enclosed in a light-transmissive envelope to a metal support strap member both of a lamp unit comprising the steps of:

(a) providing a light source enclosing a light-transmissive envelope having a base with predetermined dimensions;

(b) providing a metal support strap member having extending legs and an open and a closed shape, said open shape having a passageway with predetermined dimensions sufficient to accept insertion of said base of said envelope, said closed shape being formed by contracting said legs of said metal support member effective to reduce the dimension of said passageway;

(c) inserting said base of said envelope into the open shape of said metal support strap member;

(d) contracting said legs of said metal support member so that said passageway frictionally engages said base of said inner envelope; and (e) joining said contracted legs of said support strap members.

9. A method according to claim 8 wherein said joined contracted legs of step (e) are further connected to a support member of a light unit.

10. A light source enclosed within a light-transmissive envelope haivng a base for use in a lamp unit mountable on a vehicle and having a reflector;

said unit having a base cavity attachable to said vehicle, said base cavity having locating openings and electrical connectors for complementary acceptance and connection to said light source, said base cavity further having a metal platform;

a strap assembly comprising a first member, having affixed thereto platform members, and a second member having contractable legs, said first and second members along with said contractable legs all comprised of a flexible metal material, said first and second strap members being joined to each other, said first and second strap member separated from each other by a predetermined parameter having dimensions sufficient to receive said base of said envelope;

said first and second strap members being contracted together to form a predetermined shape and effective to cause the strap assembly to tightly engage around the base of said envelope without any electrical contact between the strap assembly and the inleads of the light source, said platform members abutting against, rigidly engaging and affixed to the metal platform of said base cavity;

said base having predetermined dimensions effective to accommodate insertion into and retention by said locating opening of said unit and effective to predeterminedly locate the light source at the focal point of the said unit;

said engagement of said strap assembly of said light source along with said affixed platform members and said retention of said platform members being effective to withstand vibrations and shock effects typically experienced by said lamp unit mounted in said vehicle.

11. A lamp unit according to claim 10 wherein said predetermined location of said light source is maintained by said strap assembly without reliance on said light source connection to said electrical terminals.

12. A lamp unit according to claim 10 wherein said contracted predetermined shape engagement of said base of said envelope to said strap assembly is substantially limited to produce only compressive stresses on said base of said envelope.

13. A lamp unit according to claim 10 wherein said vibration effects are in a range of about 50 Hz to about 5000 Hz and said shock effects are in the range of about 10 g's to about 20 g's.

14. A method of connecting a light source enclosed in a light-transmissive envelope to a metal support strap member both of a lamp unit comprising the steps of:

(a) providing a light source enclosing a light-transmissive envelope having a base with predetermined dimensions;

(b) providing a metal support member having extending legs and an open and a close shape, said metal support member further comprising platform members, said open shape having a passageway with predetermined dimensions sufficient to accept insertion of said base of said envelope, said closed shape being formed by contracting said legs of said metal support member effective to reduce the dimension of said passageway;

(c) inserting said base of said envelope into the open shape of said metal support strap member;

(d) contracting said legs of said metal support member so that said passageway frictionally engages said base of said inner envelope; and (e) joining said contracted legs of said support strap members.

* * * * *